US009951581B2

(12) United States Patent
Allen

(10) Patent No.: US 9,951,581 B2
(45) Date of Patent: Apr. 24, 2018

(54) WELLBORE SYSTEMS AND METHODS FOR SUPPLYING TREATMENT FLUIDS VIA MORE THAN ONE PATH TO A FORMATION

(71) Applicant: Jason A. Allen, Houston, TX (US)

(72) Inventor: Jason A. Allen, Houston, TX (US)

(73) Assignee: BAKER HUGHES, Houston, TX (US)

( * ) Notice: Subject to any disclaimer, the term of this patent is extended or adjusted under 35 U.S.C. 154(b) by 275 days.

(21) Appl. No.: 14/536,365

(22) Filed: Nov. 7, 2014

(65) Prior Publication Data

US 2016/0130911 A1 May 12, 2016

(51) Int. Cl.
*E21B 34/14* (2006.01)
*E21B 33/124* (2006.01)

(52) U.S. Cl.
CPC ..... *E21B 34/14* (2013.01); *E21B 33/124* (2013.01)

(58) Field of Classification Search
None
See application file for complete search history.

(56) References Cited

U.S. PATENT DOCUMENTS 3,276,523 A * 10/1966 Oliver ..... E21B 34/06 166/184
4,064,941 A * 12/1977 Smith ..... E21B 33/138 166/162
4,361,187 A * 11/1982 Luers ..... B01F 5/0413 137/860
4,384,615 A * 5/1983 Luers ..... B01F 5/0413 137/896
4,662,447 A * 5/1987 Bolin ..... E21B 43/045 166/278
5,309,988 A * 5/1994 Shy ..... E21B 34/14 166/237
6,257,803 B1 * 7/2001 McCabe ..... E02D 3/12 405/269
2005/0199390 A1 * 9/2005 Curtice ..... E21B 33/13 166/250.14
2008/0047707 A1 2/2008 Boney et al.
2011/0155390 A1 * 6/2011 Lannom ..... E21B 27/02 166/369

OTHER PUBLICATIONS

PCT International Search Report and Written Opinion; International Application No. PCT/US2015/059465;International Filing Date: Nov. 6, 2015; dated Jan. 27, 2016; pp. 1-13.

* cited by examiner

*Primary Examiner* — Giovanna C. Wright
(74) *Attorney, Agent, or Firm* — Cantor Colburn LLP

(57) ABSTRACT

In one aspect an apparatus for use in a wellbore is disclosed that in one non-limiting embodiment includes an assembly deployable in the wellbore that includes a first fluid flow path for supplying a first fluid from a surface location to a formation zone along the wellbore and a second fluid flow path for supplying a second fluid from a surface location to the formation zone and a flow control device that combines the first fluid and the second fluid before supplying the combined fluid to the zone and may controls the proportions of such fluid to the formation zone.

14 Claims, 2 Drawing Sheets

WELLBORE SYSTEMS AND METHODS FOR SUPPLYING TREATMENT FLUIDS VIA MORE THAN ONE PATH TO A FORMATION

BACKGROUND

1. Field of the Disclosure

This disclosure relates generally to a treating formation zones, including fracturing, gravel packing and flooding.

2. Background of the Art

Wellbores are drilled in subsurface formations for the production of hydrocarbons (oil and gas), which are trapped in various traps or zones in the subsurface formations at different wellbore depths. Such zones are referred to as reservoirs or hydrocarbon-bearing formations or production zones. A casing is generally placed inside the wellbore and the space between the casing and the wellbore (annulus) is filled with cement. A completion string or assembly containing a number of devices is placed inside the casing to perform a variety of operations downhole, including, but not limited to, fracturing, gravel packing and flooding zones with a fluid supplied from the surface. Typically, the completion assembly includes an outer assembly and an inner or service assembly placed inside the outer assembly to treat the wellbore zones. The outer assembly typically contains a variety of devices, such as packers to isolate zones, flow port devices to provide fluid communication between inside of the outer assembly and the formation, sand screens for preventing or mitigating flow of solid particles above a certain size from the formation to the inside of the outer string. The inner assembly contains devices to open and close or operate a number of devices in the outer assembly and to provide a fluid path from the surface to the outer assembly. To treat a zone, the treatment fluid is supplied to the inside of the inner assembly, which is supplied to the formation via a port in the inner assembly and another port in the outer assembly. This single fluid path provides an upper limit to the amount of the treatment fluid that can be supplied to a zone.

The disclosure herein provides apparatus and methods for supplying a treatment fluid to a zone via more than one fluid path to increase the rate of the supplied fluid.

SUMMARY

In one aspect an apparatus for use in a wellbore is disclosed that in one non-limiting embodiment includes an assembly deployable in the wellbore that includes a first fluid flow path for supplying a first fluid from a surface location to a formation zone along the wellbore and a second fluid flow path for supplying a second fluid from a surface location to the formation zone.

In yet another aspect, a method of supplying fluid to a formation surrounding a wellbore is disclosed that in one non-limiting embodiment includes: supplying a first fluid to a first location in the wellbore; supplying a second fluid to a second location in the wellbore; combining the first fluid and the second fluid in the wellbore; and supplying the combined fluid to the formation zone.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
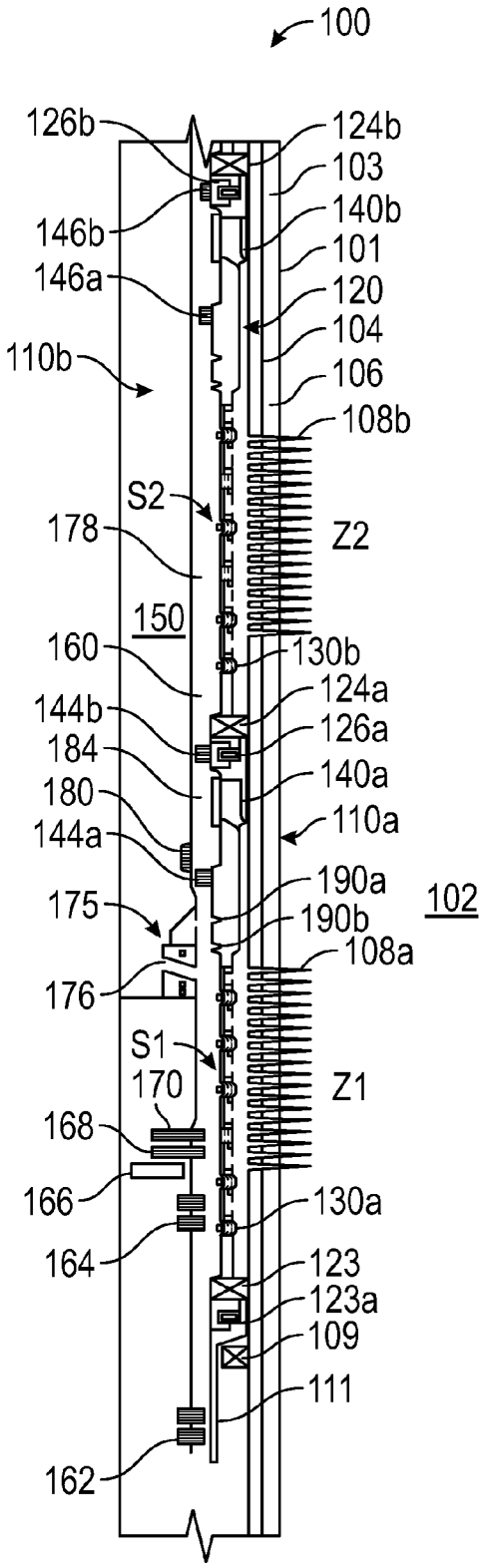
FIG. 1 shows a wellbore including production zones with a completion assembly therein for treating the production zones with a treatment fluid.

FIG. 1 shows a cased-hole wellbore system 100 that includes a wellbore 101 formed through a formation 102. That may include one or more production zones. Apparatus and methods disclosed herein equally apply to open hole wells, i.e., wells that do not include a casing. The wellbore 101 is shown to include two production zones, a lower production zone Z1 and an upper production zone Z2. The wellbore 101 is shown lined with a casing 104 and the space or the annulus 103 between the wellbore 101 and the casing 104 is filled with cement 106. Zone Z1 includes perforations 108*a* formed through the casing 104 and cement 106, while Zone Z2 includes perforations 108*b* provide. The perforations 108*a* and 108*b* establish fluid communication between their respective zones and inside of the wellbore 101. The wellbore 101 is also shown to include a sump packer 109.

To treat zones Z1 and Z2, a completion assembly or string containing an outer assembly or string 120 and an inner or service assembly or string 160 are placed or deployed inside the casing 104. In one exemplary non-limiting embodiment, the outer assembly 120 includes a section 110*a* corresponding to zone Z1 and section 110*b* corresponding to zone Z2. The outer string 120 includes a lower packer 123 and an associated packer setting device 123*a*. Section 110*a* further includes a sand screen S1, a monitoring valve 130*a* and a flow port (also referred to as "frac-sleeve") 140*a* and an isolation packer 124*a*. A packer setting device 126*a* may be used to set or activate the packer 124*a*. Similarly, the upper section 110*b* includes a screen S2, a monitoring valve 130*b*, an isolation packer 124*b* and a packer setting device 126*b*. Seals 144*a* and 144*b* are provided to isolate a section above and below the frac sleeve 140*a* and seals 146*a* and 146*b* for isolating a section above and below frac sleeve 140*b*.

Still referring to FIG. 1, the inner assembly 160 includes an opening and closing tool 162 that opens and closes various devices in the outer assembly 120, including frac sleeves 140*a* and 140*b* and monitoring valves 130*a* and 130*b*. The inner assembly further includes a reversing valve 166, a locating tool 168 and a set down tool 170. The inner assembly 160 further includes a cross-over tool that includes a frac port 175 having a fluid passage 176 for supplying a fluid 150 from inside the inner assembly 160 to the frac sleeves 140*a* and 140*b*. The inner assembly 160 is typically placed inside the outer assembly and then both assemblies are run into the wellbore. A lower end 111 of the outer assembly 120 is stabbed into the sump packer 109 to seal the area between the outer string 120 and the casing 104 below the sump packer 109. To treat a zone, such as zone Z1, the lower packer 123 and the isolation packer 124*a* are set or deployed using their respective packer setting devices 123*a* and 126*a*. Such devices and methods for setting packers are known in the art and thus not described in detail herein. The inner assembly 160 further includes a flow control device 180, such as sliding sleeve valve, to provide fluid communication between the inner string and the space or annulus 178 between the outer assembly 120 and the inner assembly 160 above the frac port 175 to selectively provide fluid communication between the inner assembly 160 and the outer assembly 120 above the frac port 175. The flow control device 180 also is referred to herein as a mixing valve. The outer assembly 120 and the inner assembly 160 are run into the wellbore 101 with certain flow control devices closed, such as frac sleeves 140*a* and 140*b*, monitoring valves 130*a* and 130*b* and packers 124*a* and 124*b* in their collapsed or unset positions.

Figure 2:
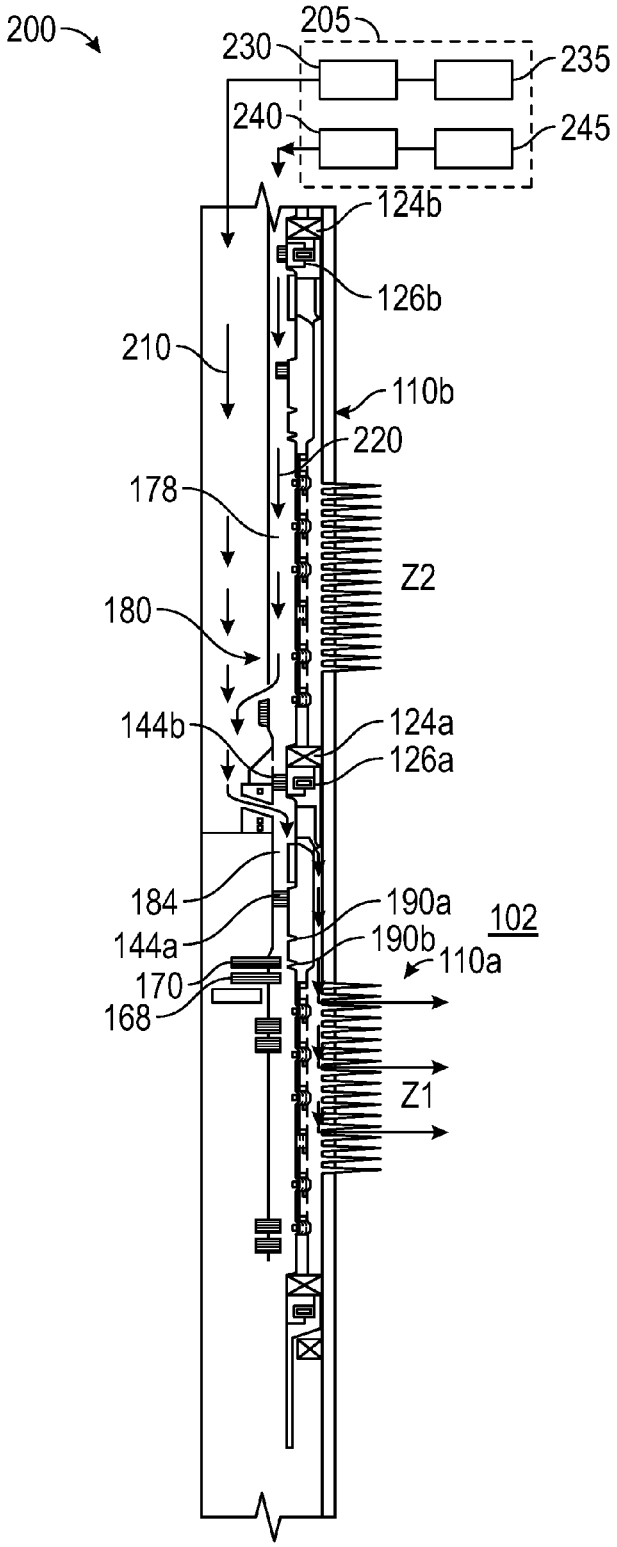
FIG. 2 shows the system of FIG. 1 that is configured or set up for treatment a lower zone according to an embodiment of the disclosure.

Referring now to FIGS. 1 and 2, to treat a particular zone, such as zone Z1, isolation packer 124*a* is set hydraulically via the packer setting device 126*a* to isolate zone Z1 from the other zones. In the system 200 of FIG. 2, packer 124*a* is shown darkened indicating that it has been set while packer 124*b* is shown not darkened, indicating that it has not yet been set. In other embodiments, both packers 124*a* and 124*b* may be set at the same time. Also, the packers may be configured to be set mechanically or by any other mechanism available in the art. The inner assembly 160 is then manipulated (typically moved up and down) to open the monitoring valve 140*a* and the frac sleeve 140*a* as shown in FIG. 2. The inner string 160 is also manipulated to cause the locating tool 168 to locate a locating profile 190*a* in section 110*a* and then set down the setting tool 170 at a set down profile 190*b* in the outer string 120 to cause the frac port 175 to align with the open frac sleeve 140*a* as shown in FIG. 2. Seals 144*a* and 144*b* are activated to seal an area 184 between the inner assembly 160 and the outer assembly 120 above and below the frac sleeve 140*a*. The flow device 180 in the inner string is opened to establish fluid communication between annuls 178 above the seal 144*b* and the inner assembly 160 above the frac port 175. At this stage a fluid path 210 exists between the surface and the frac port 175 via inside of the inner assembly 160 and another flow path 220 from the surface to the frac port 175 via the annulus 178 and the flow port 180. To treat the zone Z1 a fluid supply system or unit 205 is provided at the surface. In one non-limiting embodiment, the supply system 205 includes a pump 230 to supply a treatment fluid 235 into the flow path 210 and another pump 240 to supply a treatment fluid 245 to the flow path 220. In another embodiment, the supply system 200 may utilize a common pump to supply both fluids 235 and 245. In yet another embodiment, the fluids 235 and 245 may be the same or different. For example, fluid 235 may include a different additive and/or a different amount of a proppant than contained in fluid 245. The system 200 of FIG. 2 provides at least two fluid paths for supplying a common fluid or different fluids to a formation zone. Additional fluid paths may be provided. The system 200 further provides the ability to supply a larger amount of the treatment fluids to a zone compared to a single fluid path through the inner assembly 160 or the annulus 178. Also, the fluids 235 and 245 may be supplied at different rates and at the same or different pressures. The flow control device in the inner assembly may control the proportions of the fluids supplied to the formation zones.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore for treating a formation zone along a wellbore, comprising:

an assembly deployable in the wellbore, the assembly including:

an outer string;

an inner string including a tubular having a frac port, the tubular defining a first fluid flow path on an inside of the tubular for supplying a first fluid from a surface location to the frac port;

a second fluid flow path on an outside of the tubular between the inner string and outer string for supplying a second fluid from the surface location;

a flow control device that combines the first fluid and the second fluid, wherein second fluid is supplied into the first fluid via the flow control device and the combined fluid is supplied to the formation zone from within the inner string via the frac port; and a first barrier that prevents the flow of the first fluid below a first selected location and a second barrier that prevents the flow of the second fluid from reaching the formation zone prior to the combining of the first fluid and the second fluid.

2. The apparatus of claim 1, wherein the first flow path and the second flow path are independent of each other prior to the combining of the first fluid and the second fluid.

3. The apparatus of claim 1, wherein the first fluid is slurry for treating the formation zone.

4. The apparatus of claim 1 further comprising a fluid supply system that supplies the first fluid and the second fluid in a manner that is one of: a first pump that supplies the first fluid into the first fluid flow path and a second pump that supplies the second fluid into the second fluid flow path; a pump that supplies a common fluid into the first fluid flow path and the second fluid flow path, wherein fluid flowing through the first fluid flow path defines the first fluid and the fluid flowing through the second fluid flow path defines the second fluid.

5. The apparatus of claim 1 further comprising a flow control device for controlling the flow of the combined fluid to the formation zone.

6. The apparatus of claim 1, wherein the assembly is configured to be placed inside a casing in the wellbore that has been perforated at the formation zone.

7. The apparatus of claim 1 further comprising a screen that at least inhibits flow of solid particles above a selected size to flow from the wellbore into the tubular.

8. The apparatus of claim 1, wherein:

the outer string includes an isolation packer that isolates the formation zone.

9. A method of supplying fluid to a formation zone along a wellbore, the method comprising:

providing an inner string and an outer string in the wellbore;

providing a first barrier that prevents the flow of a first fluid below a first selected location in the wellbore and a second barrier that prevents the flow of a second fluid from reaching the formation zone prior to the combining of the first fluid and the second fluid;

supplying the first fluid to the first location in the wellbore via a first fluid path within the inner string;

supplying the second fluid to the second location in the wellbore via a second fluid path between the inner string and outer string;

combining the second fluid into the first fluid in the wellbore by opening a mixing device in the inner string; and supplying the combined fluid from within the inner string to the formation zone via a frac sleeve.

10. The method of claim 9, wherein combining the first fluid and the second fluid further comprises:

combining the first fluid and the second fluid via a device to provide a combined fluid; and supplying the combined fluid to the formation zone.

11. The method of claim 9 further comprising controlling the flow of the combined fluid into the formation zone by a flow control device in the wellbore.

12. The method of claim 9 further comprising using a system to supply the first fluid and the second fluid that is selected from a group consisting of: a first pump to supply the first fluid and a second pump to supply the second fluid; a unit that supplies the a common fluid as the first fluid and the second fluid.

13. The method of claim 9 further comprising:

supplying the first fluid from a surface location at first pressure and supplying the second fluid from the surface location at a second pressure.

14. The method of claim 9, wherein at least one of the first fluid and the second fluid contains a proppant.

* * * * *